US005833444A

United States Patent [19]

Harris et al.

[11] Patent Number: 5,833,444

[45] Date of Patent: Nov. 10, 1998

[54] FLUID DRIVEN MOTORS

[76] Inventors: Gary L. Harris, 5902 Bent Tree Ct., Humble, Tex. 77346; Hector D. Susman, 9 Graigston Gardens, Westhill Estate, Aberdeen, Scotland, AB32-6NL; Kenneth R. Stewart, 58 Angusfield Avenue, Aberdeen, Scotland, AB2-6AS

[21] Appl. No.: 726,281

[22] Filed: Oct. 4, 1996

Related U.S. Application Data

[63] Continuation-in-part of Ser. No. 650,284, May 20, 1996, which is a continuation-in-part of Ser. No. 456,790, Jun. 1, 1995, Pat. No. 5,518,379, which is a continuation-in-part of Ser. No. 181,693, Jan. 13, 1994, abandoned.

[51] Int. Cl.[6] ..... F01C 19/02

[52] U.S. Cl. ..... 418/113; 418/188; 418/249

[58] Field of Search ..... 37/322, 323, 324, 37/325, 335, 342, 344; 418/188, 249, 113

[56] References Cited

U.S. PATENT DOCUMENTS

| | | | |
|---|---|---|---|
| 807,421 | 12/1905 | Dickison | 418/225 |
| 888,806 | 5/1908 | Hopkins | 418/124 |
| 970,942 | 9/1910 | Moses | 418/225 |
| 1,892,217 | 12/1932 | Moineau | 74/458 |
| 1,997,184 | 4/1935 | Ruehman | 418/225 |
| 2,660,402 | 12/1953 | Devine et al. | 175/107 |
| 2,725,013 | 11/1955 | Vlachos | 418/225 |
| 2,870,747 | 1/1959 | Gurries | 121/86 |
| 3,016,019 | 1/1962 | Rineer | 418/221 |
| 3,048,120 | 8/1962 | Ohyagi | 418/188 |
| 3,076,514 | 2/1963 | Garrison | 175/107 |
| 3,088,529 | 5/1963 | Cullent et al. . | |

(List continued on next page.)

FOREIGN PATENT DOCUMENTS

| | | | |
|---|---|---|---|
| 978151 | 12/1948 | France . | |
| 2567571 | 12/1983 | France . | |
| 944190 | 6/1956 | Germany | 418/188 |
| 1266648 | 7/1957 | Germany . | |
| 900044 | 1/1982 | U.S.S.R. | 418/188 |
| 856687 | 12/1960 | United Kingdom . | |
| 1291720 | 10/1972 | United Kingdom . | |
| 2201734 | 9/1988 | United Kingdom . | |
| 2297777 | 8/1996 | United Kingdom . | |
| PCT/AU84/ 00212 | 4/1985 | WIPO . | |

(List continued on next page.)

OTHER PUBLICATIONS

PCT Search Report, PCT App. No. PCT/GB95/00069 Corresponding to the parent US case of this application (No Date).

"New Directions in Down–Hole Drilling," Robbins & Myers, one page, prior to 1993.

"Robbins & Myers, Inc.," Robbins & Myers, one page, prior to 1993.

"Vari–Flo Motir," Volker Stevin Offshore (U.K.) Ltd., two pages, prior to 1993.

"The Vari–Flo Motor: A New Mud Motor Concept, its Design, Development and Applications," Susman, 6 pages, 1992.

*Primary Examiner*—Tamara L. Graysay
*Assistant Examiner*—Thomas A. Beach
*Attorney, Agent, or Firm*—Guy McClung

[57] ABSTRACT

There is disclosed a fluid driven motor of particular use, for example, in drilling apparatus or in powering underwater excavation apparatus. Known motors suffer from a number of problems, e.g. lack of sufficient hydraulic efficiency. According to one aspect of the present invention there is provided a motor comprising a stator and a rotor rotatably mounted in the stator, wherein the stator is provided with at least one rod recess formed in an inner surface thereof, the stator providing at least one inlet/exhaust port communicating between a surface of the rod recess and an outer surface of the stator, the rotor is provided with a rotor channel and at least one channel for conducting motive fluid from the rotor channel to a chamber between the rotor and the stator, and the at least one rod recess is provided with a rod which, in use, may form a seal between the stator and the rotor.

9 Claims, 7 Drawing Sheets

U.S. PATENT DOCUMENTS

Figure 1:
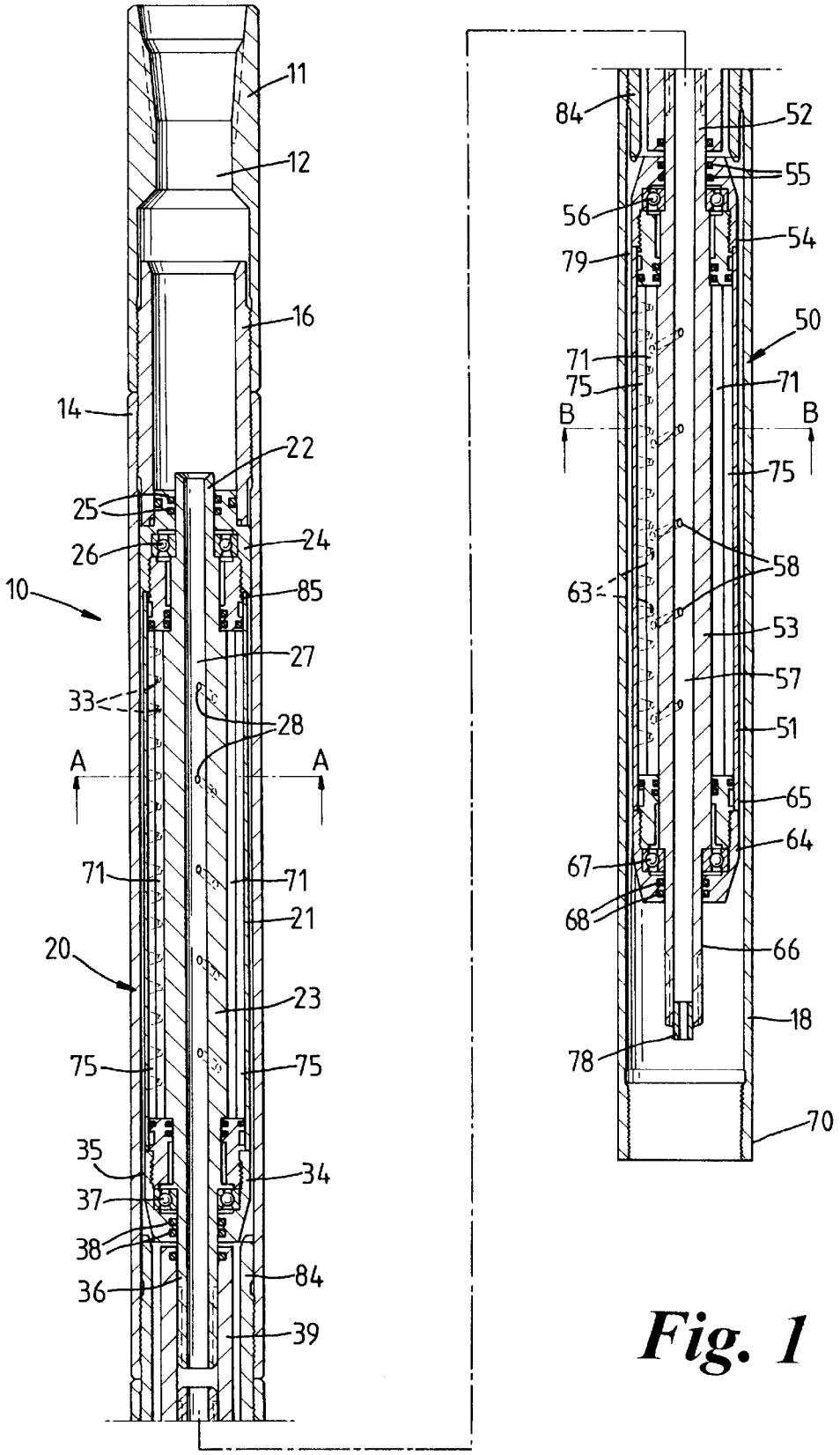

| | | | |
|---|---|---|---|
| 3,103,893 | 9/1963 | Henning et al. | 103/120 |
| 3,120,154 | 2/1964 | Gilreath . | |
| 3,574,493 | 4/1971 | Hamilton | 418/268 |
| 3,618,236 | 11/1971 | Pipkin | 37/323 |
| 3,657,829 | 4/1972 | Lovelace | 37/323 |
| 3,772,805 | 11/1973 | De Koning | 37/308 |
| 3,838,953 | 10/1974 | Peterson | 418/186 |
| 3,840,080 | 10/1974 | Berryman | 175/107 |
| 3,966,369 | 6/1976 | Garrison . | |
| 3,999,312 | 12/1976 | Yamaguchi et al. | 37/308 |
| 4,009,973 | 3/1977 | Heinrich | 418/104 |
| 4,105,377 | 8/1978 | Mayall | 418/173 |
| 4,462,469 | 7/1984 | Brown | 175/40 |
| 4,485,879 | 12/1984 | Kamp et al. | 15/61 |
| 4,492,276 | 1/1985 | Kamp | 175/61 |
| 4,813,497 | 3/1989 | Wenzel | 175/74 |
| 4,817,740 | 4/1989 | Beimgraben | 175/74 |
| 5,030,071 | 7/1991 | Simpson | 418/13 |
| 5,052,501 | 10/1991 | Wenzel et al. | 175/74 |
| 5,171,138 | 12/1992 | Forrest | 418/48 |
| 5,171,139 | 12/1992 | Underwood et al. | 418/48 |
| 5,171,140 | 12/1992 | Schafer et al. | 418/55.2 |
| 5,174,391 | 12/1992 | Zijsling | 175/57 |
| 5,174,392 | 12/1992 | Reinhardt | 175/107 |
| 5,195,882 | 3/1993 | Freeman | 418/171 |
| 5,337,840 | 8/1994 | Chancey et al. | 175/107 |
| 5,350,242 | 9/1994 | Wenzel | 384/97 |
| 5,460,496 | 10/1995 | Van-Drentham Susman | 418/225 |

FOREIGN PATENT DOCUMENTS

| | | |
|---|---|---|
| 90/09510 | 8/1990 | WIPO . |
| PCT/GB92/01917 | 4/1993 | WIPO . |
| PCT/NL94/0001 | 7/1994 | WIPO . |
| WO94/16198 | 7/1994 | WIPO . |
| WO95/19488 | 7/1995 | WIPO . |

FLUID DRIVEN MOTORS

RELATED APPLICATIONS

This is a continuation-in-part of pending U.S. Ser. No. 08/650,284 filed May 20, 1996 entitled "Wellbore Motor System," which is a continuation-in-part of U.S. Ser. No. 456,790 filed Jun. 1, 1995 entitled "Downhole Motor System," now issued as U.S. Pat. No. 5,518,379 on Jun. 21, 1996, which is a continuation-in-part of U.S. Ser. No. 181,693 filed Jan. 13, 1994 entitled "Drilling Motor," now abandoned.

This invention relates to fluid driven motors and in particular, though not exclusively, to hydraulic motors for use in, for example, drilling apparatus or in powering underwater excavation apparatus.

Fluid driven or hydraulic motors of the type wherein a rotor is rotatably mounted within a stator are known. Motors such as these have been used to power drilling apparatus in oil/gas wells, e.g. for deviated drilling. The same motors have also been found suitable for use in underwater excavation apparatus. Known motors suffer from a number of problems, e.g. lack of sufficient hydraulic efficiency, e.g. when used in excavation apparatus where the performance requirements of the motor to be used differ significantly from those for drilling apparatus. For example, in a drilling environment the hydraulic efficiency of the motor is not normally of paramount importance as the remaining energy in the drilling fluid can be dissipated in the drill bit and/or used to transport drill cuttings to the surface. In excavation apparatus, however, the efficiency of the motor has a direct bearing on the rating of the pumps used to supply fluid. Hence in order to minimize the size and complexity of the pumps it is desirable to maximize the hydraulic efficiency of the motor. It is an object therefore of the present invention to obviate or mitigate at least some of the aforementioned problems/disadvantages.

According to one aspect of the present invention there is provided a motor comprising a stator and a rotor rotatably mounted in said stator, wherein said stator is provided with at least one rod recess formed in an inner surface thereof, the stator providing at least one inlet/exhaust port communicating between a surface of the at least one rod recess and an outer surface of the stator, said rotor is provided with a rotor channel and at least one channel for conducting motive fluid from said rotor channel to a chamber between said rotor and said stator, and said at least one rod recess is provided with a rod which, in use, may form a seal between said stator and said rotor.

In a first embodiment the at least one rod recess and rod may further act as a valve which, according to the position of said rotor relative to said stator, serves to open and close the inlet/exhaust port.

In a second embodiment the at least one inlet/exhaust port may be adapted such that, in use, rotation of the rotor, does not cause the at least one inlet/exhaust port to be closed.

This feature is particularly beneficial in seeking to allow continous flow of drive fluid through the motor, thereby, for example, obviating or mitigating hydraulic hose vibration.

In the second embodiment the at least one inlet/exhaust port may be formed such that at least a portion of the port communicates between a portion of the inner surface of the stator which does not form part of the rod recess and the outer surface of the stator.

The rotor may be provided with at least one seal for engagement with the stator.

Preferably, said seal is made from a material selected from the group consisting of plastics materials, polyethylethylketone, metal, copper alloys and stainless steel.

Advantageously, said rotor is made from a material selected from the group consisting of plastics materials, polyethylethylketone, metal copper alloys and stainless steel.

Preferably, said stator is provided with two rod recesses which are disposed opposite one another, each rod recess being provided with a respective rod, and said rotor being provided with two seals which are disposed opposite one another.

The motor may be driven in reverse so as to act as a pump.

According to a second aspect of the present invention there is provided a motor comprising a stator and a rotor rotatably mounted in said stator, wherein said stator is provided with at least one combined rod recess and inlet/exhaust port, said rotor is provided with a rotor channel and at least one channel for conducting motive fluid from said rotor channel to a chamber between said rotor and said stator, and said at least one combined rod recess and inlet/exhaust port is provided with a rod which, in use, may form a seal between said stator and said rotor.

According to a third aspect of the present invention two or more motors according to the first aspect may be arranged with their respective rotors connected together.

Said motors may be connected in parallel, although they could be connected in series if desired.

Advantageously said motors may be arranged so that, in use, said motors operate out of phase with one another. Thus two motors with two chambers each may be connected 90 degrees out of phase with one another. Similarly, two motors each with four chambers may be connected 45 degrees out of phase. Arrangements such as these help to ensure a smooth power output and inhibit stalling.

According to a fourth aspect of the present invention there is provided an underwater excavation apparatus comprising a hollow body having at least one inlet and at least one outlet, at least one impeller rotatably mounted in the hollow body and means for driving the at least one impeller, the driving means comprising a motor according to the first aspect.

There may be provided at least one pair of impellers coaxially displaced one from the other, the driving means being capable of driving the impellers in contrary rotating directions.

The impellers may be driven by means of a gearbox or by exploitation of the opposing reactive torque on drive body of the motor.

Preferably the inlet and outlet of the hollow body are provided at opposing ends thereof, the common axis of the impellers extending between the inlet and the outlet.

The underwater excavation apparatus may further comprise an agitator device having mechanical disturbance means and fluid flow disturbance means.

The underwater excavation apparatus may be suspended from a surface vessel or mounted upon a sled of the type currently known for use in subsea excavation operations.

Figure 4:
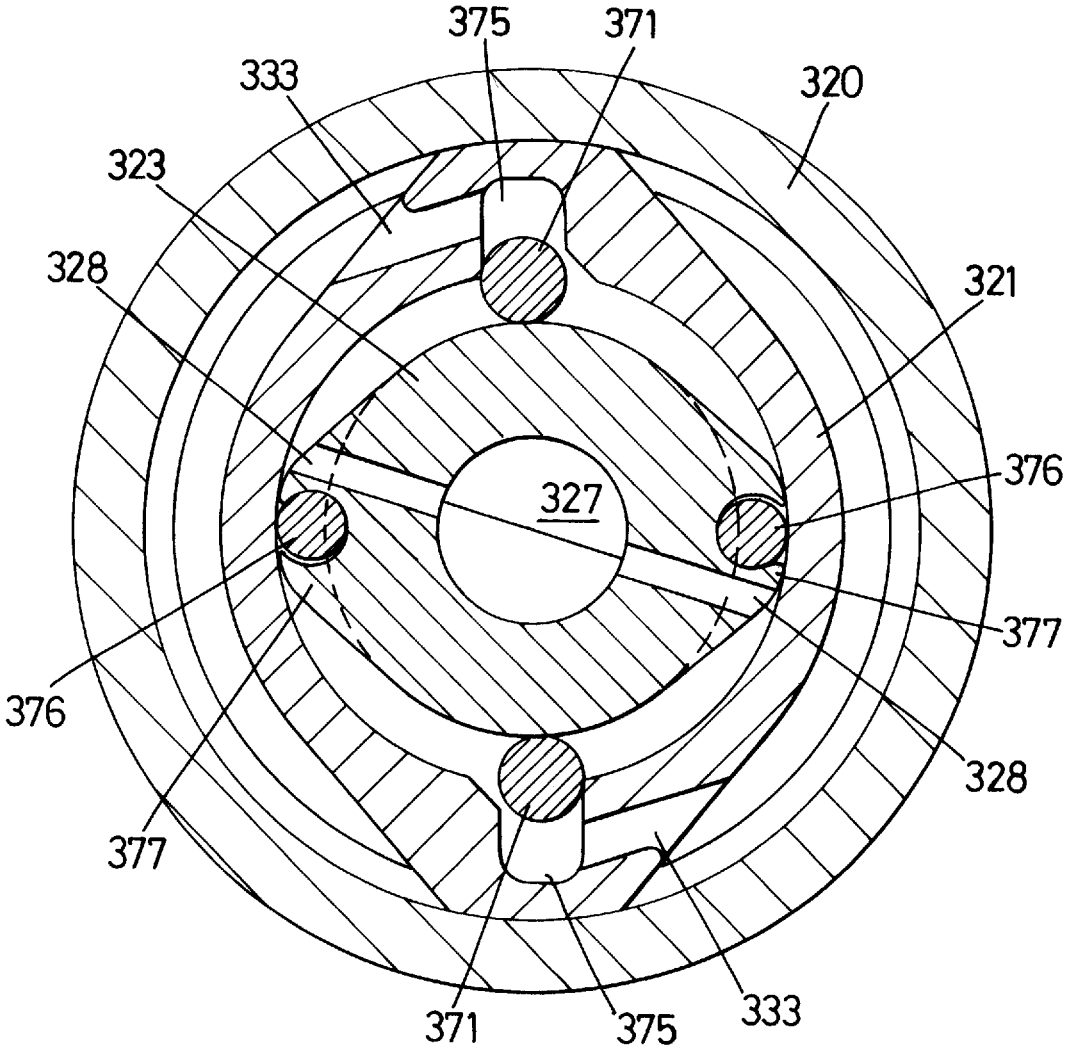
Figure 5:
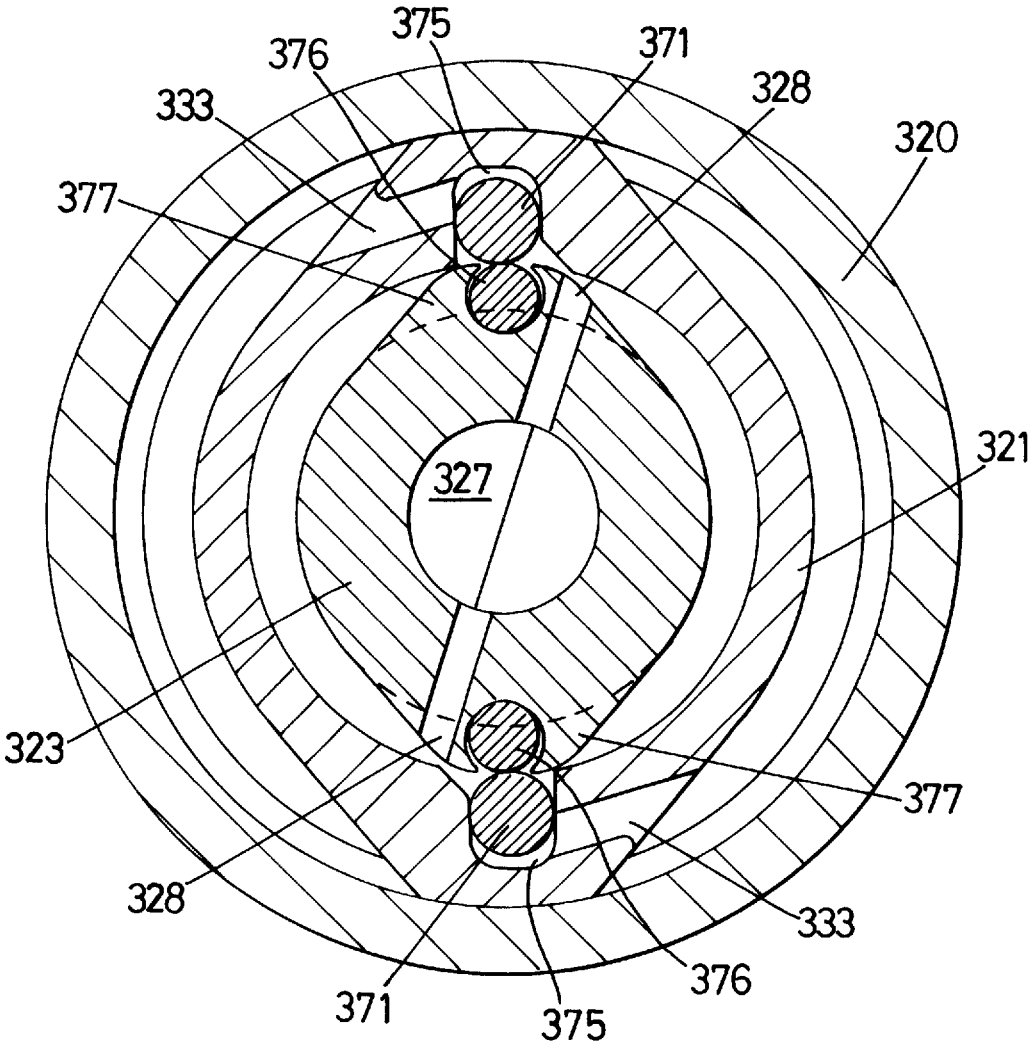
Figure 6:
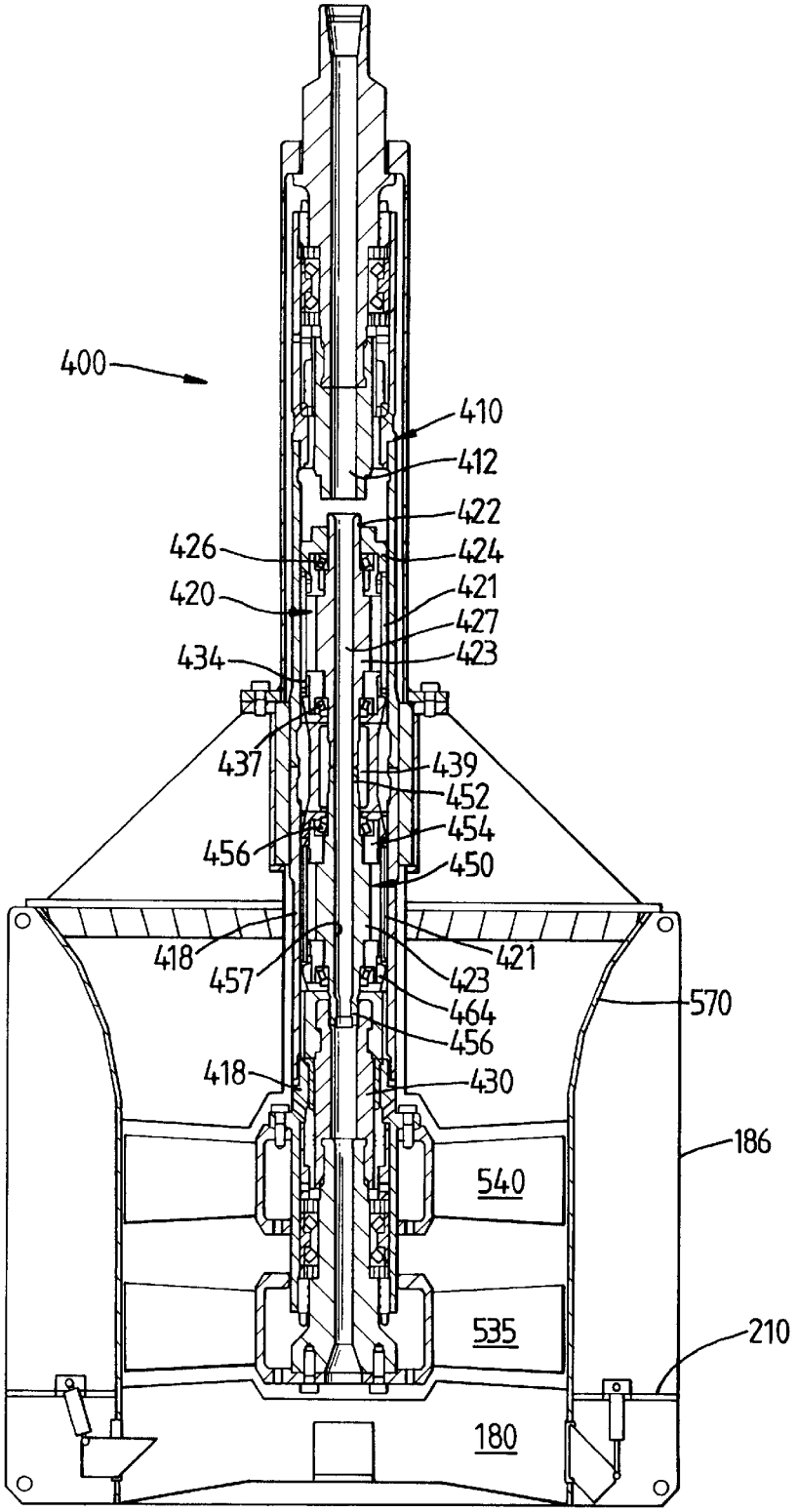
Figure 7:
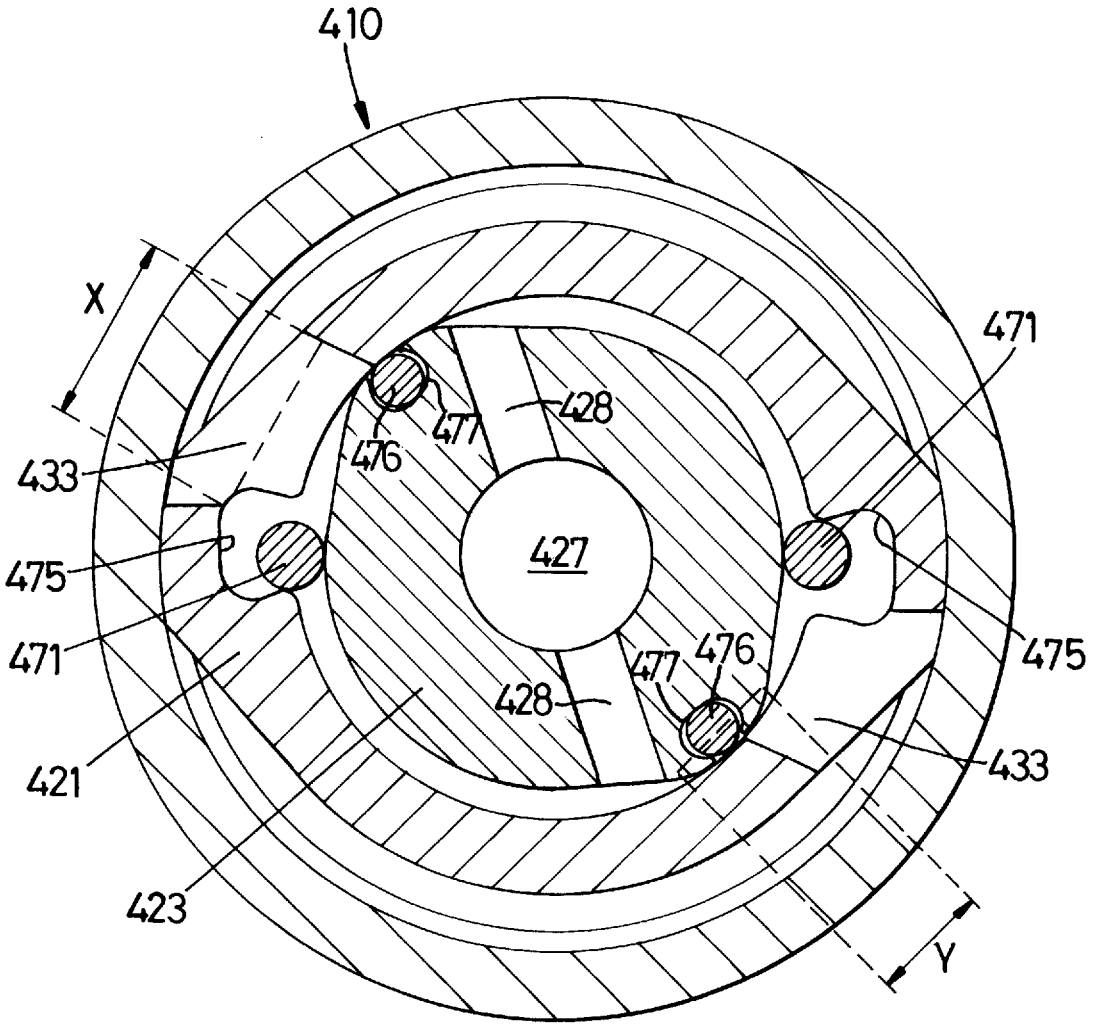

Embodiments of the present invention will now be described by way of examply only, with reference to the accompanying drawings, which are:

FIG. 1 a longitudinal cross sectional view of a drilling apparatus embodying a motor of the type known in this art;

FIGS. 2A–2D cross sectional views along line A—A of FIG. 1 showing the rotor in four different position;

FIGS. 3A–3D cross sectional views along line B—B of FIG. 1 showing the rotor in four different positions;

FIG. 4 a cross sectional view of a first embodiment of a motor in accordance with the present invention;

FIG. 5 an alternative cross sectional view of the motor of FIG. 4;

FIG. 6 a cross sectional view of an underwater excavation apparatus utilising a motor in accordance with the present invention; and FIG. 7 a cross sectional view of a second embodiment of a motor in accordance with the present invention.

Referring to FIG. 1, there is shown a drilling apparatus which is generally identified by reference numeral 10. The drilling apparatus 10 comprises a first motor 20 and a second motor 50.

The first motor 20 comprises a stator 21 and a rotor 23. A top portion 22 of the rotor 23 extends through an upper bearing assembly 24 which comprises a thrust bearing 26 and seals 25.

Motive fluid, e.g. water, drilling mud or gas under pressure, flows down through a central sub channel 12 into a central rotor channel 27, and then out through rotor flow channels 28 into action chambers 31, 32.

Following a motor power stroke, the motive fluid flows through exhaust ports 33, and then downwardly through an annular channel circumjacent the stator 21 and flow channels 35 in a lower bearing assembly 34. A portion 36 of the rotor 23 extends through the lower bearings assembly 34 which comprises a thrust bearing 37 and seals 38.

The ends of the stator 21 are castellated and the castellations engage in recesses in the respective upper bearing assembly 24 and lower bearing assembly 34 respectively to inhibit rotation of the stator 21. The upper bearing assembly 24 and lower bearing assembly 34 are a tight fit in an outer tubular member 14 and are held against rotation by compression between threaded sleeves 16 and 84.

A splined union 39 joins a splined end of the rotor 23 to a splined end of the rotor 53 of the second motor 50. The second motor 50 has a stator 51.

A top portion 52 of the rotor 53 extends through an upper bearing assembly 54. Seals 55 are disposed between the upper bearing assembly 54 and the exterior of the top portion 52 of the rotor 53. The rotor 53 moves on thrust bearings 56 with respect to the upper bearing assembly 54.

Motive fluid flows into a central rotor channel 57 from the central rotor channel 27 and then out through rotor flow channels 58 into action chambers 61 and 62. Following a motor power stroke, the motive fluid flows through exhaust ports 63 and then downwardly through an annular channel circumjacent the stator 51 and flow channels 65 in a lower bearing assembly 64. A portion 66 of the rotor 53 extends through the lower bearing assembly 64. The rotor 53 moves on thrust bearings 67 with respect to the lower bearing assembly 64 and seals 68 seal the rotor-bearing assembly interface. Also motive fluid which flowed through the flow channels 35 in the lower bearing assembly 34, flows downwardly through channels 79 in the upper bearing assembly 54, past stator 51 and through flow channels 65 in the lower bearing assembly 64.

The upper bearing assembly 54 and lower bearing assembly 64 are a tight fit in an outer tubular member 18 and are held against rotation by compression between threaded sleeve 84 and a lower threaded sleeve (not shown).

A solid plug or a flow restrictor 78 at the bottom of the rotor 53 may be used to restrict motive fluid flow to the drill bit D and to ensure that a desired amount of motive fluid passes through the motors.

Figure 2A:
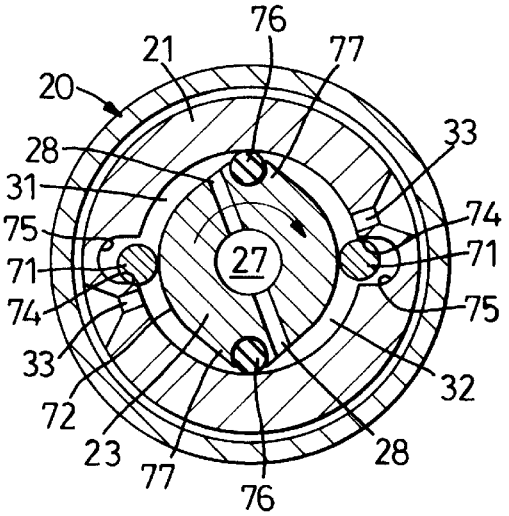
Figure 2B:
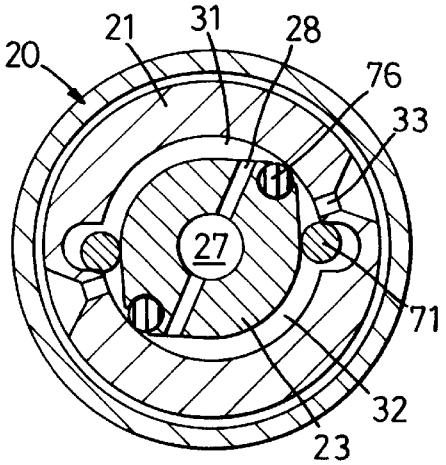
Figure 2C:
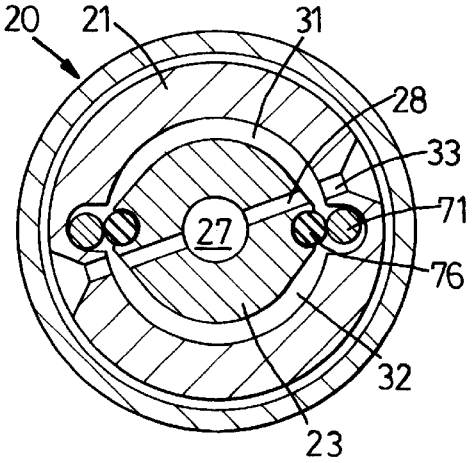

FIGS. 2A–2D and 3A–3D depict a typical cycle for the first and second motors 20 and 50 and show the status of the two motors with respect to each other at various times in the cycle. For example, FIG. 2*c* shows an exhaust period for the first motor 20 while FIG. 3*c*, at the same moment, shows a power period for the second motor 50.

As shown in FIG. 2A, motive fluid flowing through the rotor flow channels 28 enters the action chambers 31 and 32. Due to the geometry of the chambers (as discussed below) and the resultant forces, the motive fluid moves the rotor 23 in a clockwise direction as seen in FIG. 2B. The action chamber 31 is sealed at one end by a rolling vane rod 71 which abuts an exterior surface 72 of the rotor 23 and a portion 74 of a rod recess 75.

At the other end of the action chamber 31, a seal 76 on a lobe 77 of the rotor 23 sealingly abuts an interior surface of the stator 21.

As shown in FIG. 2B, the rotor 23 has moved to a point near the end of a power period.

As shown in FIG. 2C, motive fluid starts exhausting at this point in the motor cycle through the exhaust ports 33.

Figure 2D:
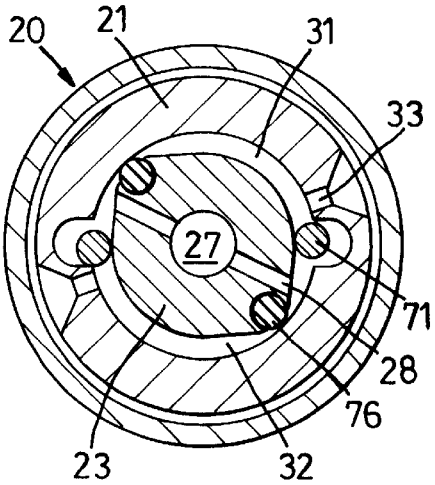
Figure 3A:
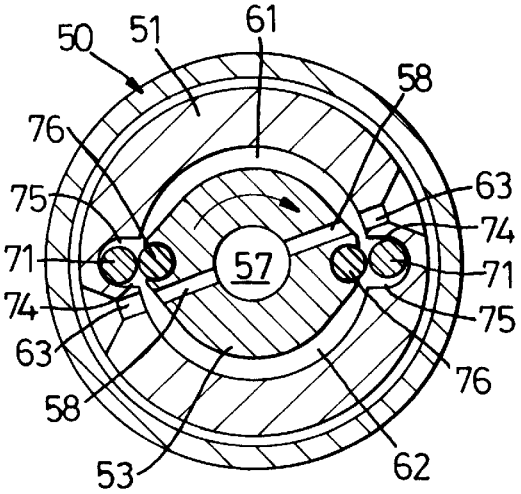
Figure 3B:
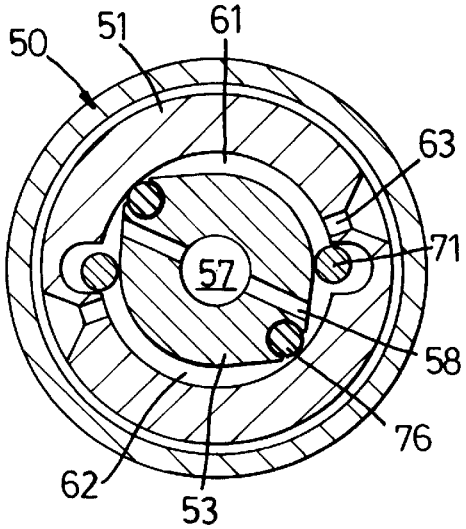
Figure 3C:
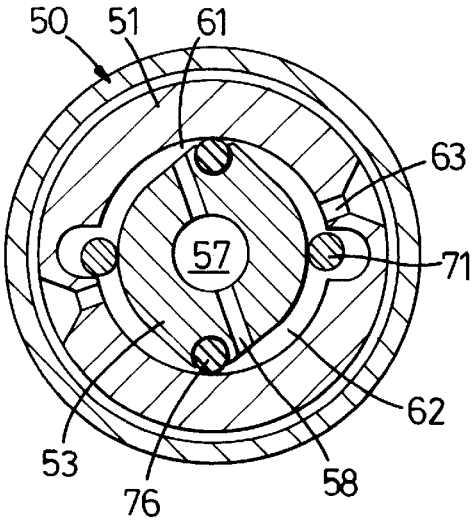
Figure 3D:
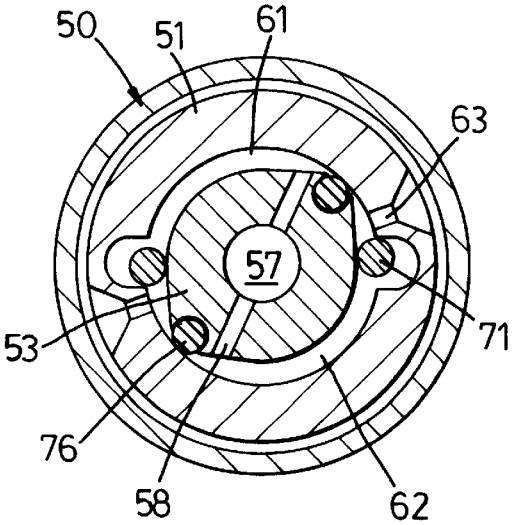

As shown in FIG. 2D, the rolling vane rods 71 and seals 76 have sealed off the action chambers and motive fluids flowing thereinto will rotate the rotor 23 until the seals 76 again move past the exhaust ports 33.

The second motor 50 operates as does the first motor 20; but, as preferred, and as shown in FIGS. 3A–3D, the two motors are out of phase by 900 so that as one motor is exhausting motive fluid the other is providing power.

The seals 76 are, in one embodiment, made of polyethylethylketone (PEEK). The rolling vane rods 71 are also made from PEEK. The rotors 23,25 and stators 21, 51 are preferably made from corrosion resistant materials such as stainless steel.

When a seal 76 in the first motor 20 rotates past an exhaust port 33, the motive fluid that caused the turning exits and flows downward through the stator adaptor 84 (FIG. 1), then through the channels 79, past the exhaust ports 63 and the flow channels 65.

FIGS. 4 and 5 show a first embodiment of a motor, generally designated 310, according to the present invention. For ease of reference like numerals are used in FIGS. 4 and 5 to designate like parts as in the first motor 20 of FIG. 1, but prefixed with '3'. The motor 310 comprises a rotor 323 and a stator 321. The rotor 323 is provided with a pair of seals 376, a pair of outlet ports 328, and a central rotor channel 327. The rotor 323 is constructed such that portions housing the seals 376 are formed into cam lobes 377. The stator 321 is further provided with a pair of rod recesses 375, rods 371 and inlet ports 333. The rods 371, when acted upon by the cam lobes 377, serve to close the inlet ports 333 as shown in FIG. 5. This alleviates a problem in existing motors 20, 50 which allow motive fluid to be vented needlessly when the inlet ports are opposite the exhaust ports.

The benefits gained from the closure of the inlet ports 333 include increases hydraulic efficiency and a reduced motor start up speed. The motor operates substantially as the known motor 20, 50 as described hereinbefore.

FIG. 6 shows an underwater excavation apparatus 400 of the type powered by a motor 410 in accordance with the present invention. For ease of reference like numerals are used in FIG. 6 to designate like parts as in the apparatus 10 of FIG. 1, but prefixed with '4'. The apparatus 400 includes a motor 410 including two motors 420, 450 according to the present invention, contra rotating impellers 535, 540 and a substantially tubular body 570. In use the excavator 400 is suspended from a surface vessel at a predetermined distance from the seabed. The height of the excavator 400 above the seabed is dependent on such factors as the depth of excavation required in the seabed, the depth at which the excavation is taking place and the consistency of the seabed among others.

The supply of pressurised fluid, usually sea-water, to the motor 410 prompts the contra-rotation of drive shaft 430 and the motor housing 421 with the resultant contra-rotation of the impellers 535, 540. The upper impeller 540 is rigidly attached to the motor housing 421 while the lower impeller is rigidly attached to the drive shaft 430. In use the excavator 400 may be operated such that the impellers 535, 540 provide a fast moving stream of water directed at the seabed.

FIG. 7 shows a second embodiment of a motor, generally designated 410, according to the present invention. For ease of reference like numerals are used in FIG. 6 to designate like parts as in the first motor 20 of FIG. 1, but prefixed with "4".

The motor 410 comprises a rotor 423 and a stator 421. The rotor 423 is provided with a pair of seals 476, a pair of outlet ports 428, and a central rotor channel 427. The rotor 423 is constructed such that portions housing the seals 476 are formed into cam lobes 477. The stator 421 is further provided with a pair of rod recesses 475, rods 471 and inlet/exhaust ports 433.

As is apparent from FIG. 7, in this embodiment, the ports 433 are formed such that at least a portion of each port 433 communicates between a portion of the inner surface of the stator 421 which does not form part of the rod recess and the outer surface of the stator.

Further, the breadth "X" of each port 433 is greater than the breadth Y of the portions of the rotor 423 which carries rods 476.

Thus, in use, rotation of the rotor 433, does not cause the inlet/exhaust ports 433 to be closed.

This feature is particularly beneficial in seeking to allow continous flow of drive fluid through the motor, thereby, for example, obviating or mitigating hydraulic hose vibration.

It should be appreciated the present the embodiments of the present invention hereinbefore described are given by way of example only, and are not meant to limit the scope of the invention in any way. Particularly it should be understood that the motor according to the present invention may be driven in reverse so as to act as a pump.

We claim:

1. A motor comprising a stator and a rotor rotatably mounted in said stator, wherein said stator is provided with at least one rod recess formed in an inner surface thereof, the stator providing at least one inlet/exhaust port communicating between a surface of the at least one rod recess and an outer surface of the stator, said rotor is provided with a rotor channel and at least one channel outlet for conducting motive fluid from said rotor channel to a chamber between said rotor and said stator, and said at least one rod recess is provided with a rod which, in use, forms a seal between said stator and said rotor.

2. A motor as claimed in claim 1, wherein the at least one rod recess and rod, in use, act as a valve which, according to the position of said rotor relative to said stator, serves to open and close the inlet/exhaust port.

3. A motor as claimed in claim 1, wherein the at least one inlet/exhaust port is adapted such that, in use, rotation of the rotor, does not cause the at least one inlet/exhaust port to be closed.

4. A motor as claimed in claim 1, wherein the at least one inlet/exhaust port is formed such that at least a portion of the port communicates between a portion of the inner surface of the stator which does not form part of the rod recess and the outer surface of the stator.

5. A motor as claimed in claim 1, wherein the rotor is provided with at least one seal for engagement with the stator.

6. A motor as claimed in claim 5, wherein said seal is made from a material selected from the group consisting of plastics materials, polyethylethylketone, metal, copper alloys and stainless steel.

7. A motor as claimed in claim 1, wherein said rotor is made from a material selected from the group consisting of plastics materials, polyethylethylketone, metal copper alloys and stainless steel.

8. A motor as claimed in claim 1, wherein said stator is provided with two rod recesses which are disposed opposite one another, each rod recess being provided with a respective rod, and said rotor being provided with two seals which are disposed opposite one another.

9. A pump comprising the motor of claim 1.

* * * * *